US006840139B2

(12) United States Patent
Haylock

(10) Patent No.: US 6,840,139 B2
(45) Date of Patent: Jan. 11, 2005

(54) TAPERED INSTALLATION TOOL

(75) Inventor: Luke L. Haylock, Culver City, CA (US)

(73) Assignee: Alcoa Global Fasteners, Inc., Torrance, CA (US)

( * ) Notice: Subject to any disclaimer, the term of this patent is extended or adjusted under 35 U.S.C. 154(b) by 0 days.

(21) Appl. No.: 10/431,709

(22) Filed: May 8, 2003

(65) Prior Publication Data

US 2004/0221689 A1 Nov. 11, 2004

(51) Int. Cl.[7] ..... B25B 13/06

(52) U.S. Cl. ..... 81/121.1; 81/119; 81/438; 81/124.3; 81/176.2; 81/461; 81/124.6; 72/75; 72/126; 411/3; 411/361

(58) Field of Search ..... 81/121.1, 119, 81/438, 124.3, 176.2, 461, 124.6; 72/75, 126; 411/3, 361

(56) References Cited

U.S. PATENT DOCUMENTS

| | | | | | |
|---|---|---|---|---|---|
| 4,260,005 | A | | 4/1981 | Stencel | |
| 4,383,353 | A | | 5/1983 | Stencel | |
| 4,544,312 | A | | 10/1985 | Stencel | |
| 4,601,623 | A | * | 7/1986 | Wallace | 411/336 |
| 4,649,727 | A | * | 3/1987 | Gray | 72/75 |
| 4,742,735 | A | | 5/1988 | Stencel | |
| 4,983,085 | A | * | 1/1991 | Gray | 411/361 |
| 5,061,132 | A | | 10/1991 | Cosenza | |
| 5,092,726 | A | | 3/1992 | Wheeler et al. | |
| 5,148,727 | A | * | 9/1992 | Williamson | 81/121.1 |
| 5,269,208 | A | * | 12/1993 | Kolvites et al. | 81/176.2 |
| 5,452,974 | A | * | 9/1995 | Binns | 411/3 |
| 6,047,620 | A | * | 4/2000 | Kozak et al. | 81/441 |
| 6,339,976 | B1 | * | 1/2002 | Jordan | 81/53.2 |
| 6,598,498 | B1 | * | 7/2003 | Pigford et al. | 81/53.2 |

* cited by examiner

*Primary Examiner*—Joseph J. Hail, III
*Assistant Examiner*—Alvin J Grant
(74) *Attorney, Agent, or Firm*—Brij K. Agarwal; Eckert Seamans Cherin & Mellott, LLC

(57) ABSTRACT

An improved tool for use in association with a deformable nut of a fastener includes a socket having inner surface that forms a cavity on the socket. The inner surface includes one or more engagement surfaces that are tapered inwardly at an angle that approaches a taper of a deformable wall of the deformable nut. In one embodiment the tapering of the engagement surfaces is provided by configuring the engagement surfaces to extend in a tapered fashion generally toward a central axis of the socket. In another embodiment, the tapering is provided by configuring the engagement surfaces to each extend in a spiral fashion about a spiral axis that may, for example, be parallel and spaced-apart from the central axis of the socket.

32 Claims, 7 Drawing Sheets

TAPERED INSTALLATION TOOL

BACKGROUND OF THE INVENTION

1. Field of the Invention

The present invention relates generally to fasteners and, more particularly, to a tool for use with a deformable nut of a fastener.

2. Description of the Related Art

In some fastening circumstances, it is desirable to provide a fastener having a deformable portion that resists loosening or detachment of the fastener. An example of such a fastener might include a structure similar to a bolt and a nut, with the nut being plastically deformable into engagement with the bolt. Examples of such fastening systems are described generally in, for example, U.S. Pat. No. 5,092,726 to Wheeler et al., U.S. Pat. No. 5,061,132 to Cosenza, U.S. Pat. No. 4,742,735 to Stencel, and U.S. Pat. No. 4,544,312 to Stencel.

A deformable nut for use in a fastening system such as that discussed in the aforementioned patents may, for example, include one or more radially protruding structures that can be engaged by a tool to plastically deform the protruding structures and/or other portions of the nut into engagement with a cooperative bolt. An example of such a prior art tool D is depicted in FIG. 1, and an example of a prior art deformable nut H is depicted generally in FIG. 2 in an undeformed condition. The prior art nut H is depicted generally in FIG. 3 in a deformed condition subsequent to deforming engagement by the prior art tool D.

As can be best understood from FIG. 2, the prior art nut H includes a deformable wall L and a number of lugs P. It can be seen that the deformable wall L is generally tapered in an axial direction. When the prior art tool D is received on the prior art nut H and is rotated with respect to the nut H, the lugs P are caused to deform radially inwardly, which results in the deformable wall L being plastically deformed into engagement with, for instance, a shank of a bolt (not depicted) on which the prior art nut H is disposed. It is noted that deformation of the deformable wall L is not depicted in FIG. 3 for purposes of clarity.

As can be understood from FIG. 3, however, deformation of the lug P by the prior art tool D nevertheless results in a portion of the lug P being largely undeformed, such as is shown at the numeral T. The lack of deformation at the region T results from a number of factors including the relative thinness of the deformable wall L at the tapered end being displaced by the lug P during deformation thereof instead of fully deforming the lug P and spreading the material of the lug P into engagement with the shank.

It is thus desired to provide an improved tool that deforms the lugs of a deformable nut to a relatively greater degree than was provided by prior art tooling. It is also desired to provide such a tool that requires relatively less torque to provide the desired degree of deformation.

SUMMARY OF THE INVENTION

In view of the foregoing, an improved tool in accordance with the present invention meets these and other needs. An improved tool for use in association with a deformable nut of a fastener includes a socket having inner surface that forms a cavity on the socket. The inner surface includes one or more engagement surfaces that are tapered inwardly at an angle that approaches a taper of a deformable wall of the deformable nut. In one embodiment the tapering of the engagement surfaces is provided by configuring the engagement surfaces to extend in a tapered fashion generally toward a central axis of the socket. In another embodiment, the tapering is provided by configuring the engagement surfaces to each extend in a spiral fashion about a spiral axis that may, for example, be parallel and spaced-apart from the central axis of the socket.

Accordingly, an aspect of the present invention is to provide an improved tool that can deform a deformable nut to a greater degree than previously known tools.

Another aspect of the present invention is to provide an improved tool for use in conjunction with a deformable nut that requires relatively less torque to perform the deformation function than previously known tools.

Another aspect of the present invention is to provide an improved tool for use in association with a deformable nut wherein the tool includes a number of tapered engagement surfaces that engage lugs of the deformable nut.

Another aspect of the present invention is to provide a combination of a tool and a fastener, with the fastener including a shank and a deformable nut, with the tool including one or more tapered engagement surfaces that are engageable with deformable portions of the nut to plastically deform the nut into engagement with the shank, it being understood that the shank could be or could include a splined axially threaded member.

In accordance with the foregoing, an aspect of the present invention is to provide a tool that is structured to mount a nut to a shank by plastically deforming at least a portion of the nut in a direction generally toward the shank, in which the general nature of the tool can be stated as including a socket having an interior surface that forms a cavity on the socket that includes a mouth in communication with the exterior of the socket. The socket includes a socket central axis extending through the cavity, and further includes at least a first engagement wall having a first engagement surface that is at least a portion of the interior surface. The first engagement surface is structured to engage the nut to deform the at least portion of the nut generally toward the shank. At least a portion of the first engagement surface tapers radially inwardly generally toward the socket central axis in a direction from the mouth generally toward the cavity. The cavity includes at least a first relief region adjacent the first engagement surface.

Another aspect of the present invention is to provide a tool that is structured to mount a nut to a shank by plastically deforming at least a portion of the nut in a direction generally toward the shank, in which the general nature of the tool can be stated as including a socket having an interior surface that forms a cavity on the socket and includes a mouth in communication with the exterior of the socket. The socket includes a socket central axis extending through the cavity. The socket also includes at least a first engagement wall having a first engagement surface which is at least a portion of the interior surface, with the first engagement surface being structured to engage the nut to deform the at least portion of the nut generally toward the shank. At least a portion of the first engagement surface extends in a generally spiral fashion in a direction from the mouth generally toward the cavity. The cavity includes at least a first relief region adjacent the first engagement surface.

Another aspect of the present invention is to provide a combination, the general nature of which can be stated as including a nut, a shank, and a tool. The nut includes a deformable member and a nut central axis. The deformable member extends generally in a circumferential direction with respect to the nut central axis. The nut is structured to be mounted to a shank, and at least a portion of the deformable member is structured to be deformed into engagement with the shank. The deformable member includes a deformable wall and at least a first lug, with the deformable wall including an outer wall surface opposite the nut central axis. At least a portion of the outer wall surface tapers radially inwardly generally toward the nut central axis. The at least first lug is disposed on the outer wall surface and protrudes from the outer wall surface in a direction generally away from the nut central axis. The tool includes a socket having a cavity formed therein, with the cavity defining an interior surface of the socket. The cavity includes a mouth in communication with the exterior of the socket, with the cavity being structured to receive at least a portion of the nut therein through the mouth. The socket includes a socket central axis extending through the cavity. The cavity includes at least a first relief region adjacent the first engagement surface, and the at least first lug is structured to be receivable in an undeformed condition in the at least first relief region. The socket includes at least a first engagement wall having a first engagement surface defined by at least a portion of interior surface, with the first engagement surface being structured to be engageable with the nut to deform the at least portion of the deformable member into engagement with the shank. At least a portion of the first engagement surface tapers radially inwardly generally toward the socket central axis in a direction from the mouth generally toward the cavity.

Another aspect of the present invention is to provide a combination, the general nature of which can be stated as including a nut, a shank, a tool. The nut includes a deformable member and a nut central axis, with the deformable member extending generally in a circumferential direction with respect to the nut central axis. The nut is structured to be mounted to a shank, and at least a portion of the deformable member is structured to be deformed into engagement with the shank. The deformable member includes a deformable wall and at least a first lug, with the deformable wall including an outer wall surface opposite the nut central axis. At least a portion of the outer wall surface tapers radially inwardly generally toward the nut central axis. The at least first lug is disposed on the outer wall surface and protrudes from the outer wall surface in a direction generally away from the nut central axis. The tool includes a socket having a cavity formed therein, with the cavity defining an interior surface of the socket. The cavity includes a mouth in communication with the exterior of the socket, and the cavity is structured to receive at least a portion of the nut therein through the mouth. The socket includes a socket central axis extending through the cavity. The cavity includes at least a first relief region adjacent the first engagement surface, with the at least first lug being structured to be receivable in an undeformed condition in the at least first relief region. The socket includes at least a first engagement wall having a first engagement surface defined by at least a portion of interior surface. The first engagement surface is structured to be engageable with the nut to deform the at least portion of the deformable member into engagement with the shank. At least a portion of the first engagement surface extends in a generally spiral fashion in a direction from the mouth generally toward the cavity.

BRIEF DESCRIPTION OF THE DRAWINGS

A further understanding of the invention can be gained from the following Description of the Preferred Embodiments when read in conjunction with the accompanying drawings in which.

Similar numerals refer to similar parts throughout the specification.

DESCRIPTION OF THE PREFERRED EMBODIMENTS

As used herein, the expression "a number of" and variations thereof shall be broadly construed to refer to any non-zero quantity, including a quantity of 1.

As used herein, the expression "taper" and variations thereof shall refer broadly to a departure generally toward or away from a reference, such as in the context of a surface with respect to a reference, and can refer to both linear and arcuate departures and combinations thereof.

As used herein, the expression "spiral" and variations thereof shall refer broadly to a curve with a number of turns about an axis and can include, but is not limited to, a helix.

An improved tool 4 in accordance with a first embodiment of the present invention is indicated generally in FIGS. 4–8. As can be best understood from FIG. 5, the tool 4 is cooperable with a fastener 6 having a deformable nut 8 and a shank 12. The exemplary shank 12 depicted generally in FIG. 5 as being a splined axially threaded member, although it is noted that the shank 12 could be of other configurations such as non-splined and/or non-threaded, or of other configurations, without departing from the concept of the present invention. It is also noted that the shank 12 can include threaded and/or unthreaded portions, and thus the expression "shank" and variations thereof as used herein is to be construed broadly.

Figure 1:
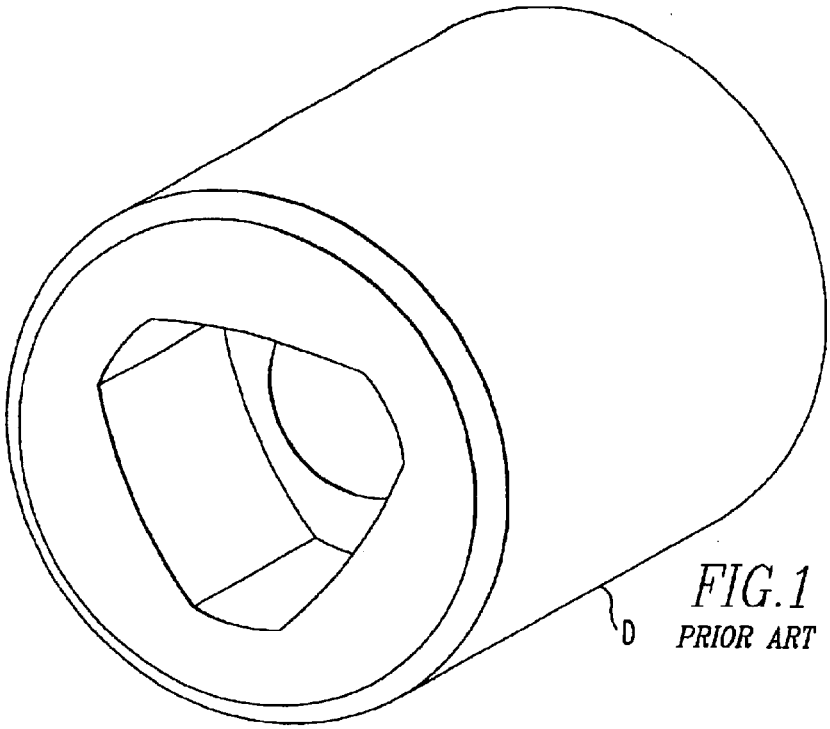
FIG.1 PRIOR ART
FIG. 1 is a perspective view of a prior art tool.
Figure 2:
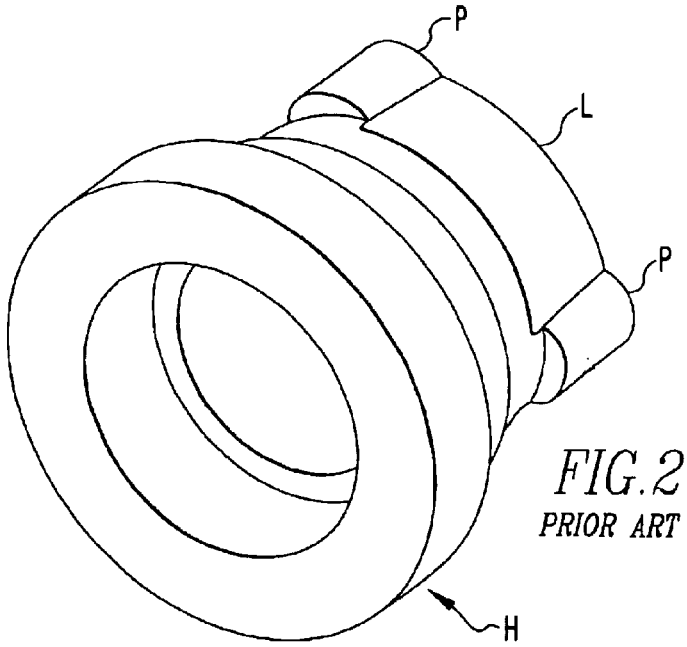
FIG.2 PRIOR ART
FIG. 2 is a perspective view of a prior art deformable nut prior to deformation thereof.

The tool 4 is advantageously configured to plastically deform at least a portion of the nut 8 into engagement with at least a portion of the shank 12, such as the splined and threaded portion thereof, to affix the nut 8 to a shank 12. The nut 8 is substantially the same as the nut H depicted generally in FIG. 2.

The nut 8 can be seen to include a deformable member 16 that extends generally circumferentially with respect to a nut central axis 24. The deformable member 16 includes a deformable wall 28 and a number of lugs 32 that are equally circumferentially spaced from one another. The deformable wall 28 includes an outer wall surface 36 that tapers generally toward the nut central axis 24 in the vicinity of the lugs 32. The lugs 32 protrude outwardly from the outer wall surface 36 in a direction radially away from the nut central axis 24.

The tool 4 includes a socket 40 and a socket central axis 44. The socket 40 includes a cavity 48 formed therein, with the cavity 48 including a mouth 52 that is in communication with the exterior of the socket 40. The cavity 48 defines an inner surface 56 on the socket 40.

Figure 6:
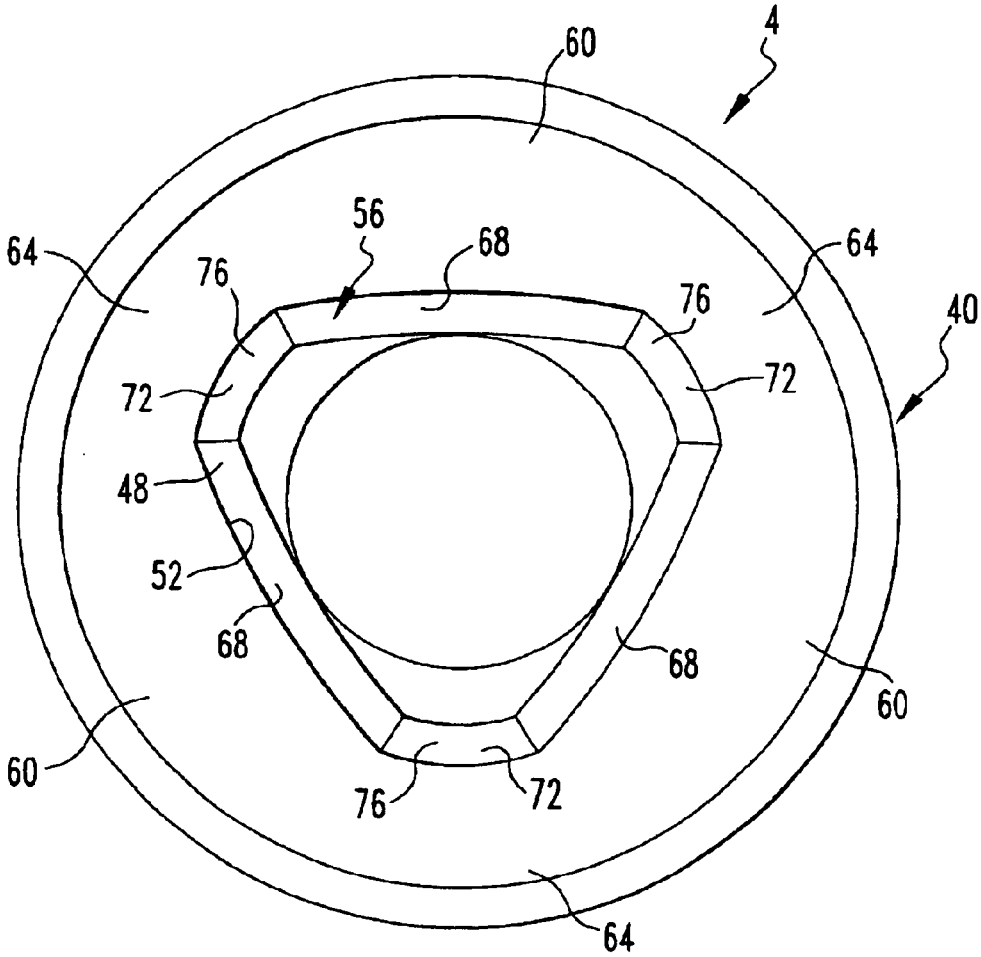
FIG. 6 is an end view of the first embodiment.

As can be best understood from FIG. 6, the socket 40 can be said to be made up of a number of engagement walls 60 and a number of relief walls 64 connected together. In practice, the engagement walls 60 and relief walls 64 likely will be defined portions of a monolithic socket 40. Each engagement wall 60 and relief wall 64 constitutes a circumferential sector or portion of the socket 40, and the engagement walls 60 and relief walls 64 together form the socket 40. The engagement walls 60 alternate circumferentially with the relief walls 64.

Each engagement wall 60 includes an engagement surface 68 thereon that is defined by the inner surface 56. Moreover, each relief wall 64 includes a relief surface 72 thereon that is defined by the inner surface 56. Each engagement surface 68 extends generally smoothly between the pair of relief surfaces 72 adjacent thereto, and each relief surface 72 extends substantially smoothly between the pair of engagement surfaces 68 that are adjacent thereto.

Figure 4:
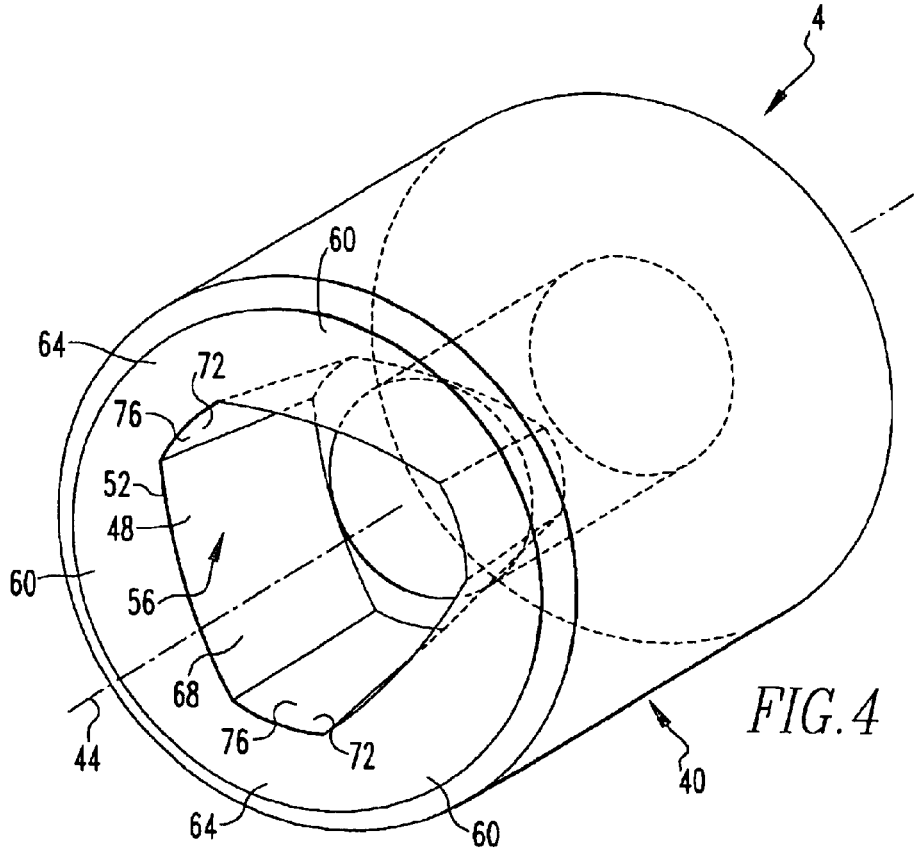
FIG. 4 is a perspective view of an improved tool in accordance with a first embodiment of the present invention.
Figure 5:
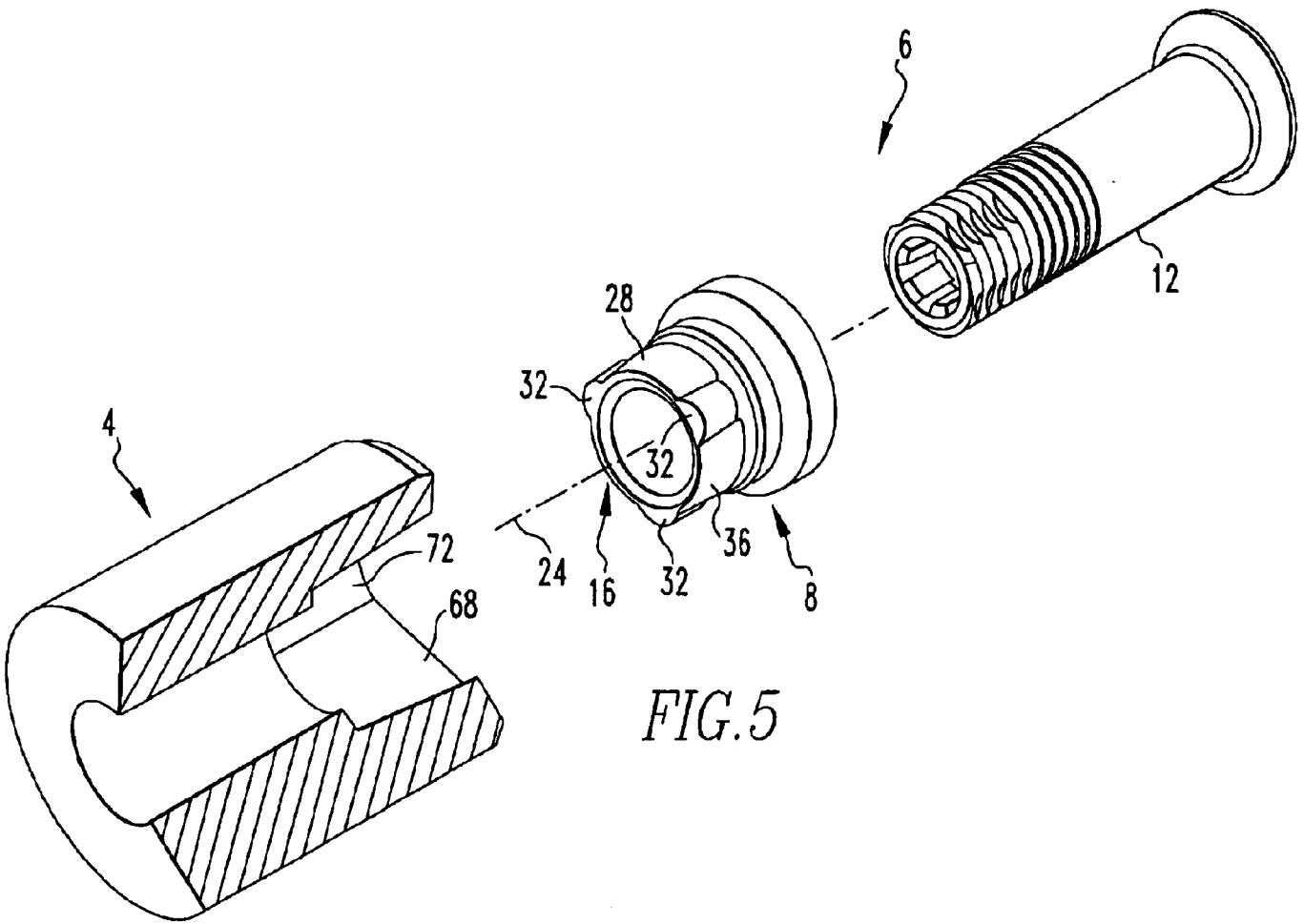
FIG. 5 is an exploded perspective view of a combination in accordance with the present invention including the improved tool of FIG. 4 partially cut away, the prior art nut of FIG. 2, and a shank.

As can be understood from FIGS. 4 and 6, the engagement surfaces 68 do not extend in a direction parallel with the socket central axis 44. Rather, the engagement surfaces 68 taper generally toward the socket central axis 44 away the mouth 52. Stated otherwise, the engagement surfaces 68 taper generally toward the socket central axis 44 when the engagement surfaces 68 are considered in a direction from the mouth 52 generally toward the cavity 48. Such tapering of the engagement surfaces 68 is particularly depicted in FIGS. 7 and 8.

Figure 7:
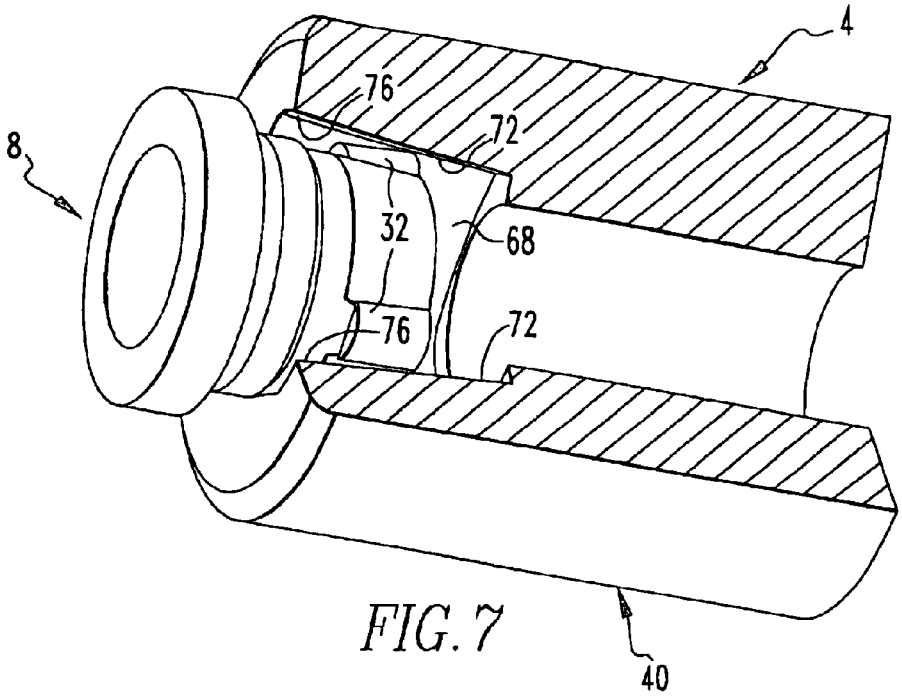
FIG. 7 is a perspective view, partially cut away, depicting the prior art nut received in a cavity of the tool of the first embodiment prior to deformation of the nut.

Each relief wall 64, with its corresponding relief surface 72, defines a relief region 76 disposed circumferentially between the corresponding pair of engagement surfaces 68. When the nut 68 is received through the mouth 52 into the cavity 48 such that the lugs 32 are disposed generally in the relief regions 76, such as is depicted in FIG. 7, neither the engagement surfaces 68 nor the relief surfaces 72 are in physical contact with the lugs 32. While the exemplary tool 4 is depicted as including relief surfaces 72 that are discontinuous with or distinct from the engagement surfaces 68, it is understood that in other embodiments of the present invention the tool 4 can be configured such that the engagement surfaces 68 engage with one another to define relief regions 76 in the vicinities of the regions of engagement between adjacent engagement surfaces 68 without providing separately defined relief surfaces 72. The relief surfaces 72 of the depicted embodiment are generally spaced farther away from the socket central axis 44 than the portions of the engagement surfaces 68 that are tapered inwardly generally toward the socket central axis 44 and that are configured to deformably engage the lugs 32.

FIG. 7 depicts the nut 8 being received in the cavity 48 of the tool 4 such that the lugs 32 are disposed in the relief regions 76. The outer wall surface 36 of the deformable wall 28 of the nut 8 tapers in a steeper fashion generally toward the nut central axis 24 than the engagement surfaces 68 taper generally toward the socket central axis 44. In this regard, the taper of the engagement surfaces 68 can be said to approach the taper of the outer wall surface 36 without providing contact therebetween. It is understood that in other embodiments of the invention the tapering of the outer wall surface 36 and the engagement surfaces 68 can be equal and/or can provide physical contact therebetween.

Figure 3:
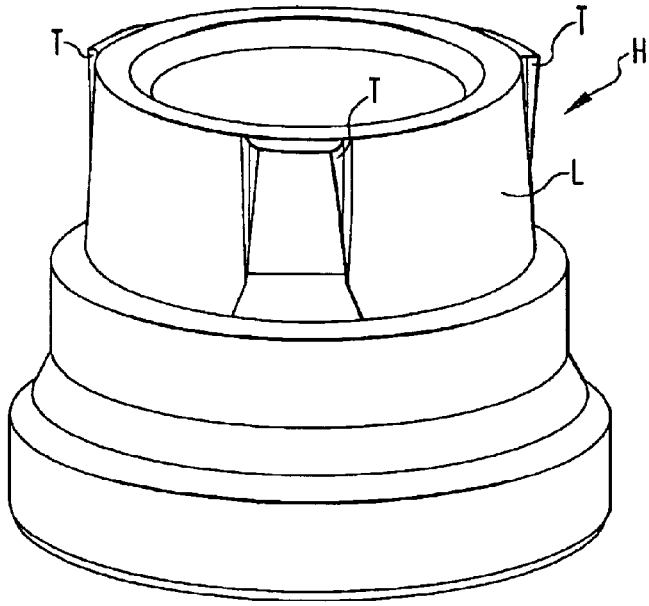
FIG. 3 PRIOR ART
FIG. 3 is a view similar to FIG. 2, except depicting the prior art nut in a deformed condition after deformation by the prior art tool of FIG. 1.
Figure 8:
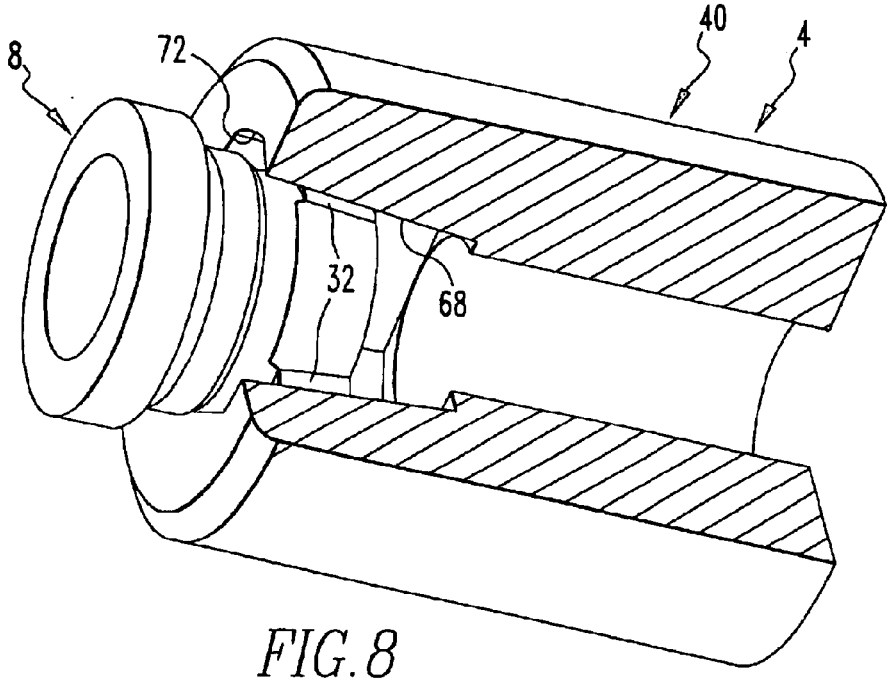
FIG. 8 is a view similar to FIG. 7, except depicting the nut during deformation thereof.
Figure 9:
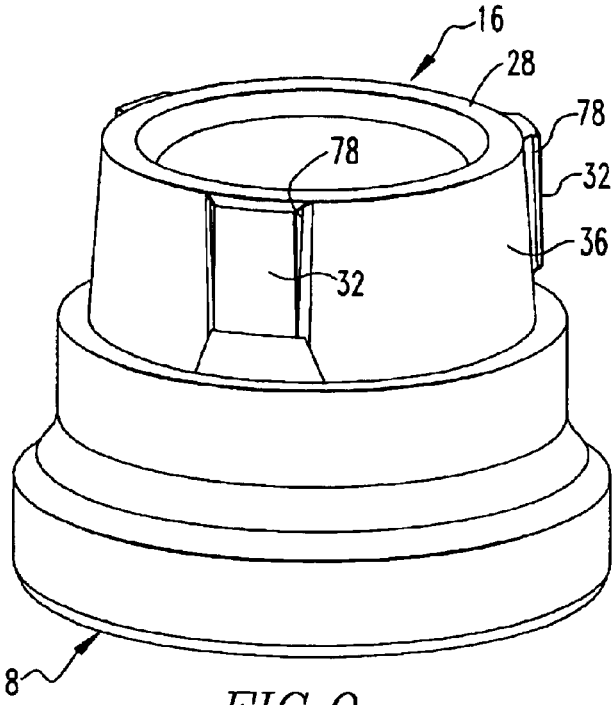
FIG. 9 is a perspective view of the nut after deformation by the improved tool of the first embodiment.

As can be seen in FIG. 8, when the tool 4 is rotated with respect to the nut 8 about the socket central axis 44, the engagement surfaces 68 engage the lugs 32 and plastically deform the lugs 32, as well as the associated portions of the deformable wall 28, into deformed engagement with the shank 12 (not specifically depicted in FIG. 8). The deformed nut 8 with its lugs 32 in a deformed condition is depicted generally in FIG. 9. The peripheral regions 78 of the deformed lugs 32 of FIG. 9 can be seen to be smaller than the peripheral regions shown at the numeral T in FIG. 3, i.e., the peripheral regions 78 protrude radially outwardly from the outer wall surface 36 a lesser distance than the peripheral regions T of FIG. 3.

The tapering of the engagement surfaces 68 thus has the effect of deforming the lugs 32 to a relatively greater degree than was provided by the prior art tool D. In this regard, the material of the lugs 32 is spread to a greater degree by the tool 4 than by the prior art tool D, which provides better deformed engagement between the nut 8 and the shank 12. The prior art tool D largely caused the radially inward deflection of the lugs P by deforming the deformable wall L without spreading the material of the lugs P. The tool 4 of the present invention, by providing the tapered engagement surfaces 68, advantageously provides a greater degree of deformation and spreading of the material of the lugs 32 than was previously known.

Figure 10:
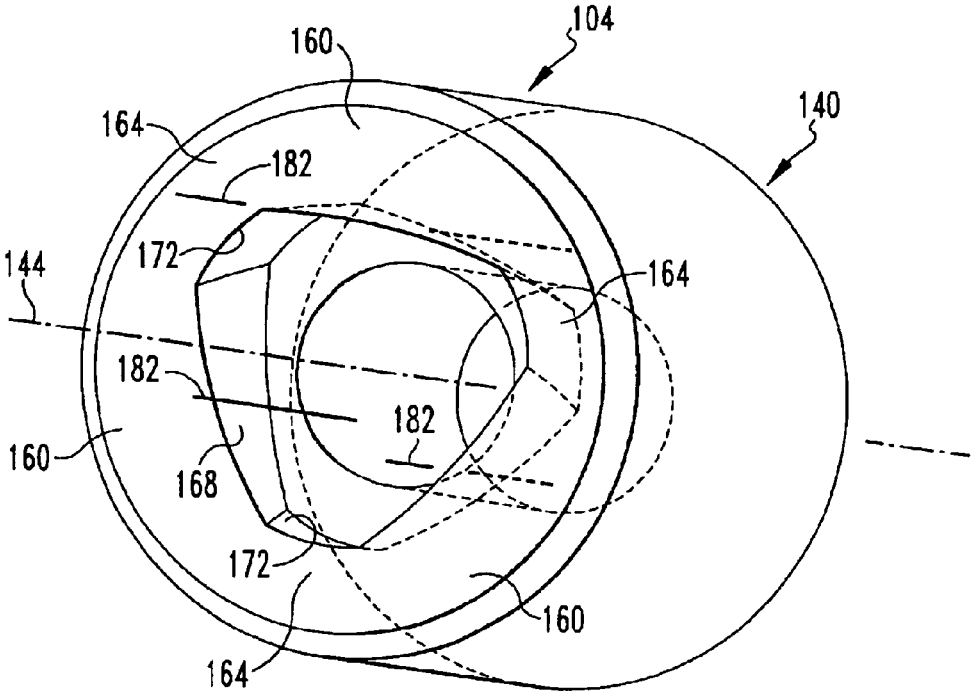
FIG. 10 is a perspective view of an improved tool in accordance with a second embodiment of the present invention.
Figure 11:
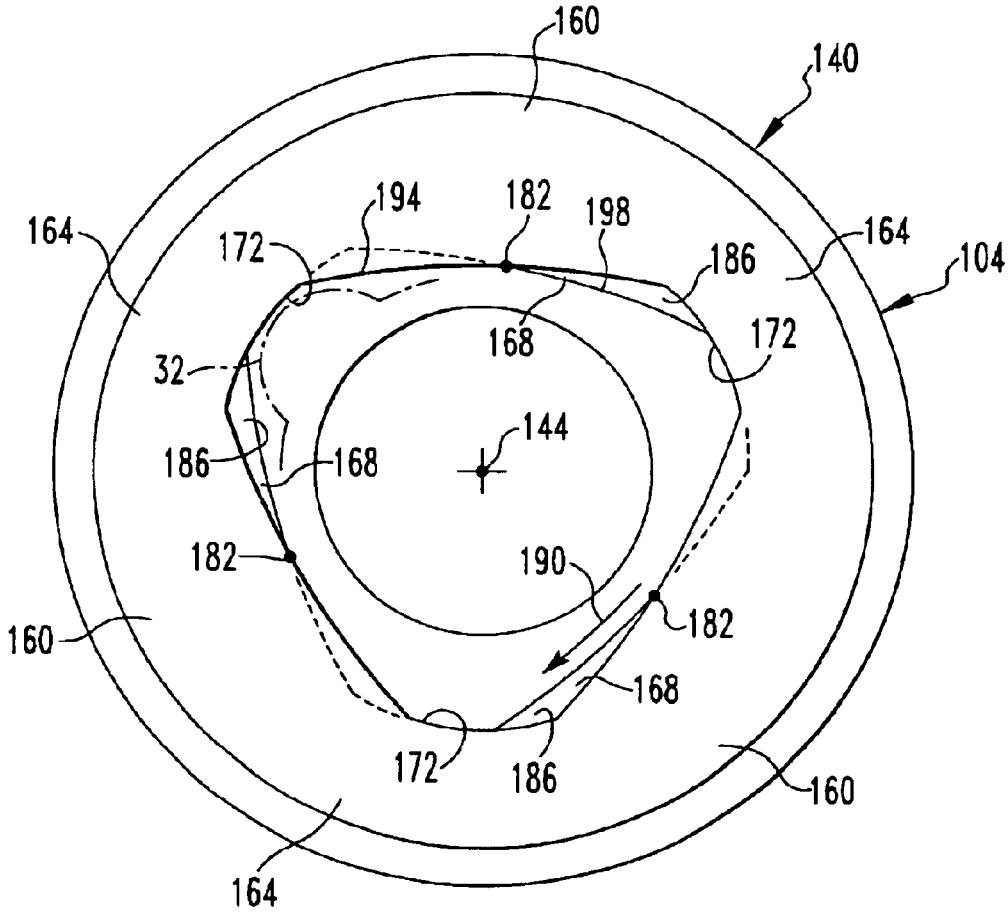
FIG. 11 is an end view of the second embodiment.

An improved tool 104 in accordance with a second embodiment of the present invention is indicated generally in FIGS. 10 and 11. The tool 104 includes a socket 140 that is similar to the socket 40, except that the engagement walls 160 provide a tapering in that the engagement walls 160 each extend in a spiral fashion along a spiral axis 182 that is parallel with and spaced from the socket central axis 144. The inwardly tapering portions of the engagement surfaces 168 are particularly depicted at the numeral 186 in FIG. 11. As can be understood from FIG. 10, the engagement walls 160 each include an engagement surface 168 that can be said to extend in a roughly helical fashion about the socket central axis 144. The tool 104 also includes relief walls 164, with each relief wall 164 having a relief surface 172.

The engagement surfaces 168 thus can be said to provide a taper in two directions. That is, portions of the engagement surfaces 168 can be seen to taper radially inwardly in the axial direction, as is shown at the numeral 186, and portions of the engagement surfaces 168 can be seen to taper radially inwardly in a circumferential direction, such as the circumferential direction indicated by an arrow 190 in FIG. 11.

Such dual directional tapering causing the engagement surfaces 168 to engage the lugs 32 at an oblique angle with respect to the longitudinal extent thereof, i.e., the axial direction, which resultingly requires a relatively lower level of torque to deform the lugs 32 than is required in association with the tool 4. An imaginary lug 32 is depicted in FIG. 11. If the tool 104 is rotated in a counter-clockwise direction with respect to the lug 32, a leading portion 194 of the engagement surface 168 will be first to contact the lug 32 at one end thereof. As the tool 104 continues to be rotated in the counter-clockwise direction, successive portions of the engagement surface 168 progressively engage the lug 32 until a trailing portion 198 of the engagement surface 168 engages the lug 32 at the top thereof. It thus can be seen that deformation of the lug 32 by the tool 104 occurs upon the rotation of the tool 104 through a greater angle of rotation of the tool 104 than is required by the tool 4 to deform the lug 32. As such, since the deformation of the lug occurs over a greater rotational arc in using the tool 104, the torque required to use the tool 104 to deform the lug 32 is of a lesser degree than the torque required in deforming the lugs 32 with the tool 4.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A tool structured to mount a nut to a shank by plastically deforming at least a portion of the nut in a direction generally toward the shank, the tool comprising:

a socket having an interior surf that forms a cavity on the socket;

the cavity including a mouth in communication with the exterior of the socket;

the socket including a socket central axis extending through the cavity;

the socket including at least a first engagement wall having a first engagement surface which is at least a portion of the interior surface the first engagement surface being structured to engage the nut to deform the at least portion of the nut generally toward the shank;

at least a portion of the first engagement surface tapering radially inwardly generally toward the socket central axis in a direction from the mouth generally toward the cavity; and the cavity including at least a first relief region adjacent the first engagement surface.

2. The tool of claim 1, wherein the interior surface includes a second engagement wall and a second relief region;

the second engagement wall having a second engagement surface which is at least a portion of the interior surface;

the at least first relief region being disposed circumferentially between the first and second engagement surfaces.

3. The tool of claim 2, wherein the socket includes at least a first relief wall;

the relief wall being disposed circumferentially between the at least first and second engagement walls;

the at least first relief region being disposed adjacent the at least first relief wall.

4. The tool of claim 3, wherein the at least first relief wall includes a first relief surface, the first relief surface extending between the at least first and second engagement surface.

5. The tool of claim 4, wherein at least a portion of the at least first relief region is spaced farther from the socket central axis than the at least portion of the first engagement surface.

6. The tool of claim 2, wherein the second engagement surface extends generally smoothly between the at least first and second relief regions.

7. The tool of claim 1, wherein the first engagement surface extends in a generally spiral fashion in a direction from the mouth generally toward the cavity.

8. The tool of claim 7, wherein the first engagement surface extends in a generally spiral fashion about a first spiral axis that is parallel with and spaced from the socket central axis.

9. A tool structured to mount a nut to a shank by plastically deforming at least a portion of the nut in a direction generally toward the shank the tool comprising:

a socket having an interior surface that forms a cavity on the socket;

the cavity including a mouth in communication with the exterior of the socket;

the socket including a socket central axis extending through the cavity;

the socket including at least a first engagement wall having a first engagement surface which is at least a portion of the interior surface, the first engagement surface being structured to engage the nut to deform the at led portion of the nut generally toward the shank;

at least a portion of the first engagement surface extending in a generally helical fashion in a direction from the mouth generally toward the cavity; and the cavity including at least a first relief region adjacent the first engagement surface.

10. The tool of claim 9, wherein the first engagement surface extends in a generally helical fashion about a first spiral axis that is parallel with and spaced from the socket central axis.

11. The tool of claim 9, wherein the interior surface includes a second engagement wall and a second relief region;

the second engagement wall having a second engagement surface which is at least a portion of interior surface;

the at least first relief region being disposed circumferentially been the first and second engagement surfaces.

12. The tool of claim 11, wherein the socket includes at least a first relief wall;

the relief wall being disposed circumferentially between the at least first and second engagement walls;

the at cast first relief region being disposed adjacent the at least first relief wall.

13. The tool of claim 12, wherein the at least first relief wall includes a first relief surface, the first relief surface extending between the at lean first and second engagement surfaces.

14. The tool of claim 13, wherein at least a portion of the at least first relief region is spaced farther from the socket central axis than the at least portion of the first engagement surface.

15. The tool of claim 14, wherein at least a portion of the first engagement surface tapers radially inwardly generally toward the socket central axis in a direction from the mouth generally toward the cavity.

16. The tool of claim 11, wherein the second engagement surface extends generally smoothly between the at least first and second relief regions.

17. A combination comprising:

a nut;

a shank;

a tool;

the nut including a deformable member and a nut central axis, the deformable member extending generally in a circumferential direction with respect to the nut central axis, the nut being structured to be mounted to a shank, at least a portion of the deformable member being structured to be deformed into engagement with the shank;

the deformable member including a deformable wall and at least a first lug;

the deformable wall including an outer wall surface opposite the nut central axis;

at least a portion of the outer wall surface tapering radially inwardly generally toward the nut central axis;

the at least first lug being disposed on the outer wall surface and protruding form the outer tall surface in a direction generally away from the nut central axis;

the tool including a socket having an interior surface that forms a cavity on the socket;

the cavity including a mouth in communication with the exterior of the socket, the cavity being structured to receive at least a portion of the nut therein through the mouth;

the socket including a socket central axis extending through the cavity;

the cavity including at least a first relief region adjacent the first engagement surface;

the at least first lug being structured to be receivable in an undeformed condition in the at least first relief region;

the socket including at least a first engagement wall having a first engagement surface which is at least a portion of the interior surface, the first engagement surface being structured to be engageable with the nut to deform the at least portion of the deformable member into engagement with the shank; and at least a portion of the first engagement surface tapering radially inwardly generally toward the socket central axis in a direction from the mouth generally toward the cavity.

18. The combination of claim 17, wherein the interior surface includes a second engagement wall and a second relief region;

the second engagement wall having a second engagement surface that is at least a portion of interior surface;

the at least first relief region being disposed circumferentially between the first and second engagement surfaces.

19. The combination of claim 18, wherein the socket includes at least a first relief wall;

the relief wall being disposed circumferentially between the at least first and second engagement walls;

the at least first relief region being disposed adjacent the at least first relief wall.

20. The combination of claim 19, wherein the at least first relief wall includes a first relief surface, the first relief surface extending between the at least first and second engagement surfaces.

21. The combination of claim 17, wherein the first engagement surface extends in a generally spiral fashion in a direction from the mouth generally toward the cavity.

22. The combination of claim 21, wherein the first engagement surface extends in a generally spiral fashion about a first spiral axis that is parallel with and spaced from the socket central axis.

23. The combination of claim 17, wherein the at least portion of the outer wall surface tapers in a steeper fashion generally toward the nut central ends than the at least portion of the first engagement surface tapers radially inwardly generally toward the socket central axis.

24. A combination comprising:

a nut;

a shank;

a tool;

the nut including a deformable member and a nut central axis, the deformable member extending generally in a circumferential direction with respect to the nut central axis, the nut being structured to be mounted to a shank, at least a portion of the deformable member being structured to be deformed into engagement with the shank;

the deformable member including a deformable wall and at least a first lug;

the deformable wall including an outer wall surface opposite the nut central axis;

at least a portion of the outer wall surface tapering radially inwardly generally toward the nut central axis;

the at least first lug being disposed on the outer wall surface and protruding from the outer wall surface in a direction generally away from the nut central axis;

the tool including a socket having an interior surface that forms a cavity on the socket;

the cavity including a mouth in communication with the exterior of the socket, the cavity being structured to receive at least a portion of the nut therein through the mouth;

the socket including a socket central axis extending through the cavity;

the cavity including at least a first relief region adjacent the first engagement surface;

the at least first lug being structured to be receivable in an undeformed condition in the at least first relief region;

the socket including at least a first engagement wall having a first engagement surface that is at least a portion of interior surface, the first engagement surface being structured to be engageable with the nut to deform the at least portion of the deformable member into engagement with the shank; and at least a portion of the first engagement surface extending in a generally helical fashion in a direction from the mouth generally toward the cavity.

25. The combination of claim 24, wherein the interior surface includes a second engagement wall and a second relief region;

the second engagement wall having a second engagement surface which is at least a portion of interior surface;

the at least first relief region being disposed circumferentially between the first and second engagement surfaces.

26. The combination of claim 25, wherein the socket includes at least a first relief wall;

the relief wall being disposed circumferentially between the at least first and second engagement walls;

the at first relief region being disposed adjacent the at least first relief wall.

27. The combination of claim 26, wherein the at least first relief wall includes a fir relief surface, the first relief surface extending between the at least first and second engagement surfaces.

28. The combination of claim 24, wherein the first engagement surface extends in a generally helical fashion in a direction from the mouth generally toward the cavity.

29. The combination of claim 28, wherein the first engagement surface extends in a generally helical fashion about a first spiral axis that is parallel with and spaced from the socket central axis.

30. The combination of claim 24, wherein the at least portion of the outer wall surface tapers in a steeper fashion generally toward the nut central axis than the at least portion of the first engagement surface tapers radially inwardly generally toward the socket central axis.

31. The combination of claim 24, wherein the first engagement surface extends in a generally helical fashion about a first spiral axis that is parallel with and spaced from the socket central axis.

32. The combination of claim 24, wherein at least a portion of the first engagement surface tapers radially inwardly generally toward the socket central axis in a direction from the mouth generally toward the cavity.

* * * * *

UNITED STATES PATENT AND TRADEMARK OFFICE

CERTIFICATE OF CORRECTION

PATENT NO. : 6,840,139 B2
DATED : January 11, 2005
INVENTOR(S) : Haylock

It is certified that error appears in the above-identified patent and that said Letters Patent is hereby corrected as shown below:

Column 7,
Line 22, “surf” should read -- surface --.

Column 8,
Line 11, after “shank”, insert -- , --.
Line 24, “led” should read -- least --.
Line 42, “been” should read -- between --.
Line 48, “cast” should read -- least --.
Line 52, “lean” should read -- least --.

Column 9,
Line 20, “form” should read -- from --.
Line 20, “all” should read -- wall --.

Column 10,
Line 7, “ends” should read -- axis --.

Column 11,
Line 4, “fir” should read -- first --.

Signed and Sealed this

Twelfth Day of July, 2005

JON W. DUDAS
*Director of the United States Patent and Trademark Office*